US005201668A

United States Patent [19]

Endo et al.

[11] Patent Number: 5,201,668

[45] Date of Patent: Apr. 13, 1993

[54] ELECTRICAL CONNECTOR

[75] Inventors: Takayoshi Endo; Sakai Yagi; Masanori Tsuji, all of Shizuoka, Japan

[73] Assignee: Yazaki Corporation, Japan

[21] Appl. No.: 740,908

[22] Filed: Aug. 6, 1991

[30] Foreign Application Priority Data

Aug. 7, 1990 [JP] Japan ..... 2-83086[U]

[51] Int. Cl.[5] ..... H01R 29/00

[52] U.S. Cl. ..... 439/189; 439/507

[58] Field of Search ..... 439/507-513, 439/189, 723, 725

[56] References Cited

U.S. PATENT DOCUMENTS

| | | | |
|---|---|---|---|
| 3,275,765 | 9/1966 | Ferdon et al. | 439/507 |
| 3,686,619 | 8/1972 | McCardell, Jr. et al. . | |
| 4,462,655 | 7/1984 | Campbell et al. | 439/507 |
| 4,952,155 | 8/1990 | Kuzuno et al. | 439/189 |
| 4,954,093 | 9/1990 | Nadin | 439/512 |
| 5,055,058 | 10/1991 | Nagasaka et al. | 439/509 |

FOREIGN PATENT DOCUMENTS

| | | |
|---|---|---|
| 54-11515 | 5/1979 | Japan . |
| 61-27718 | 12/1986 | Japan . |

*Primary Examiner*—Larry I. Schwartz
*Assistant Examiner*—Hien D. Vu
*Attorney, Agent, or Firm*—Wigman & Cohen

[57] ABSTRACT

An improved electrical connector is described herein. The electrical connector comprises a female connector member having including a plurality of electrical terminals therein and a male connector member including a plurality of electrical terminals therein. The male connector member is adapted to fit to the female connector member to establish electrical connection between the terminals of these connector members. The electrical connector further includes a connecting member for establishing electrical connection among at least two of the terminals of one of the connector members to constitute a branch circuit among wires connected to these terminals. The connecting member is adapted to be removably fitted between the at least two electrical terminals, and to achieve electrical connection therebetween through the connecting member when the connecting member is fitted.

1 Claim, 4 Drawing Sheets

ELECTRICAL CONNECTOR

BACKGROUND OF THE INVENTION

1. Field of the Invention

This invention relates to an electrical connector, and in particular to an improved electrical connector comprising a female connector member and a male connector member to be fitted into the female connector member to establish electrical connection between electrical terminals accommodated in each connector member.

2. Description of the Prior Art

In the known various types of electrical connectors, there is an electrical connector known as a joint connector. The joint connector is used when a main wire connected to a connector member of the connector is electrically connected to other wires connected to the connecting member at the connector to form a branch circuit. One of the known joint connectors is disclosed for example in Japanese Laid-open Patent Publication No. 61-277180, which is shown in FIGS. 1 and 2.

The known joint connector 1 comprises a connecting housing 3 and a male connector member 5 to be fitted into the connecting housing 3. The connecting housing 3 has a base portion 3*a* and a cylindrical hood portion 3*b* extending from the base portion 3*a* so as to define a hollow space 3*c* and a front opening 3*d*. In the base portion 3*a* of the connecting housing 3, there are embedded a plurality of flat male terminals 7 in such a manner that they extend into the hollow space 3*c*. These male terminals 7 are divided into some joint terminals 7*a* in which some male terminals are joined together at base parts thereof so as to establish electrical connection among them. Namely, as shown in FIG. 1, there are some joint terminals 7*a* in the connecting housing 3, each of which has two or three male terminals, respectively.

The male connector member 5 includes a plurality of female terminals (not shown) to which a plurality of wires 9 are connected, respectively. The female terminals are arranged so as to receive the male terminals 7 of the connecting housing 3 therein when the male connector member 5 is inserted into the hollow space 3*c* from the front opening 3*d* and then fitted to the connecting housing 3. When the connector member 5 is properly fitted to the connecting housing 3, some of the female terminals attached to the wires 9 will be electrically connected with each other through the joint terminal having the male terminals connected to the female terminals. This means that one of these wires 9, which is a main wire, can be branched to the remaining wires 9 at the joint connector 1 by means of the joint terminal 7*a*. In this case, the number of the wires to be branched at the joint connector 1 depends on the number of the male terminals 7 which constitute the joint terminal. Namely, as shown in FIG. 1, if the joint terminal has three male terminals, two wires can be branched from the main wire at the joint connector 1.

The joint connector 1 can provide a reliable branch circuit. However, as stated above, the number of the branch wires produced by this type of joint connector depends on the number of the male terminals of the joint terminal which has already embedded in the base portion of the connecting housing 3. Therefore, the degree of freedom for connecting wires for a branch circuit is restricted by the number and arrangement of the terminals of the joint terminal which has already been embedded in the base portion 3*a*. In order to overcome the problem, it may be possible to prepare different connecting housings each having different combinations of joint terminals. However, this will result in increase the manufacturing cost thereof.

In the meantime, there is another type of connector which is known as an intermediate connector. The intermediate connector is used for connecting one plurality of wires to another plurality of wires. Such an intermediate connector comprises a female connector member including a plurality of terminals connected to wires and a male connector member including a plurality of terminals connected to wires. The male connector member is constituted so as to be fittable into the female connector member, and to establish electrical connection between the wires when the terminals of each connector member are connected together. In such an intermediate connector, if some of the wires attached to the terminals of one connector member should be connected with each other in order to constitute a branch circuit, it is necessary to additionally prepare such a joint connector as described above and then connect these wires with wires of the connector member of the joint connector. This means that the known intermediate connector could not be used as a joint connector for constituting a branch circuit.

SUMMARY OF THE INVENTION

In view of the above inconvenience in the known connectors, an object of the present invention is to provide an improved electrical connector which can be used not only as a joint connector but also as an intermediate connector.

In order to achieve the above object, the improved electrical connector according to the present invention comprises a female connector member including a plurality of electrical terminals and a male connector member including a plurality of electrical terminals. The male connector member is adapted to fit to the female connector member to establish electrical connection between the terminals of these connector members. The electrical connector further includes a connecting member for establishing electrical connection among at least two of the terminals of one of the connector members to constitute a branch circuit. The connecting member is adapted to be removably fitted between the at least two electrical terminals, and to achieve electrical connection therebetween through the connecting member when the connecting member is fitted.

According to the improved electrical connector, it becomes possible to use it not only as a joint connector for producing a branch circuit but also as a mere intermediate connector for connecting wires connected to each connector member. Namely, when the connector is used as a joint connector, it is sufficient to insert the connecting member into one of the connector members. Alternatively, when the connector is used as an intermediate connector, it is sufficient to connect these connector members without using the connecting member. Further, if the connector members are connected together, having fitted the connecting member in one of the connector members, the connector can also be used as an intermediate connector. Since the connecting member has a simple structure, it is easy to prepare several types of it which can provide different connections among the terminals, thus leading to an increase the degree of freedom of producing branch circuits. Further, it will be possible to achieve cost reductions in manufacturing thereof in comparison with the conventional connectors.

The operation and other advantages of the present invention will become more clear upon reading the following detailed description of the preferred embodiment in conjunction with the accompanying drawings.

DETAILED DESCRIPTION OF THE PREFERRED EMBODIMENTS

Referring now to the accompanying drawings, a preferred embodiment according to the present invention will be explained.

Figure 1:
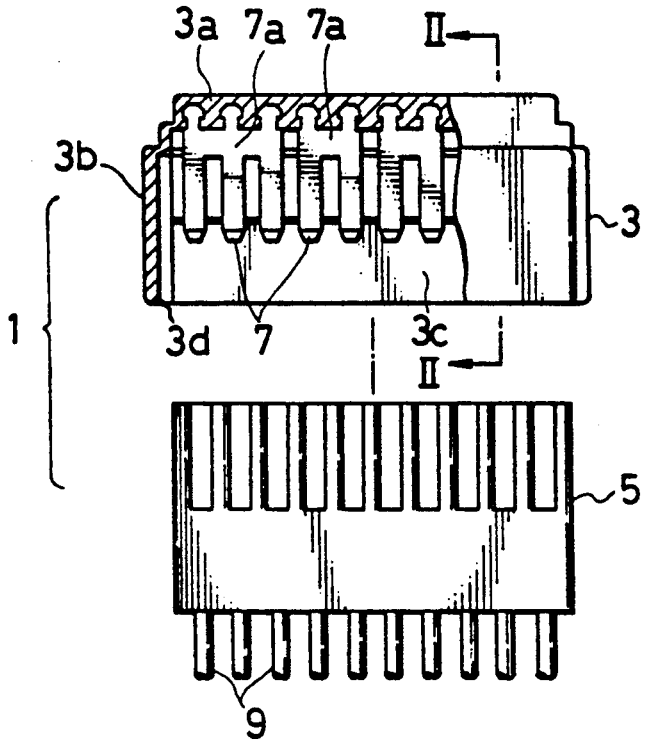
FIG.1 PRIOR ART
FIG. 1 a plan view showing a known joint connector having a connecting housing and a male connector member to be fitted to the connector housing.
Figure 2:
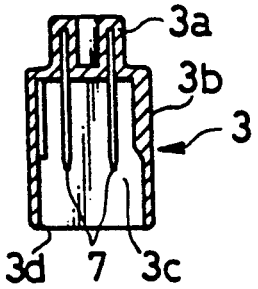
FIG.2 PRIOR ART
FIG. 2 is a sectional view of the connecting housing of the known joint connector taken along a line II–V in FIG. 1.
Figure 3:
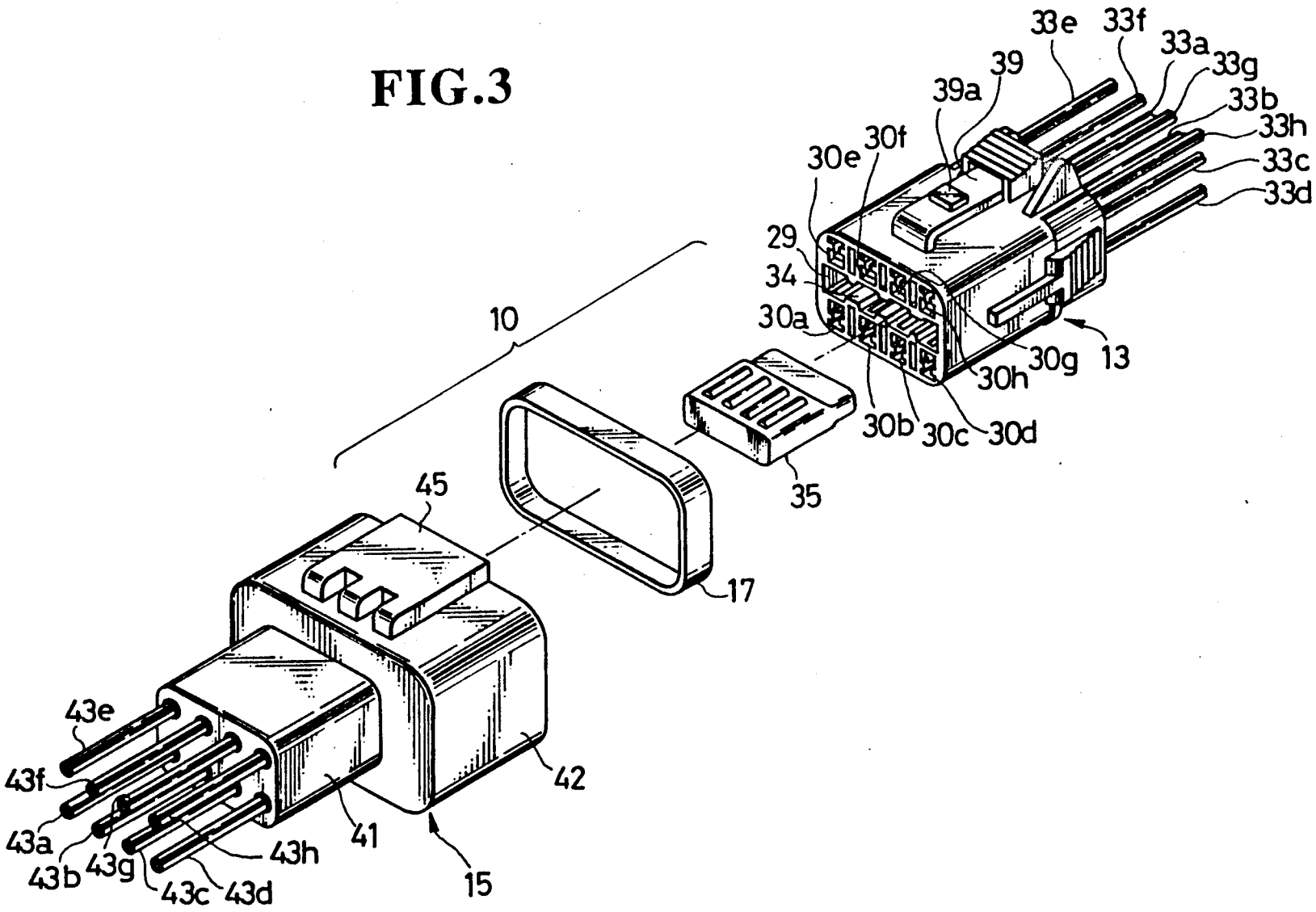
FIG. 3 is a perspective view of an embodiment of an improved electrical connector according to the present invention.

In FIG. 3, the reference numeral 10 designates an improved electrical connector according to the present invention. The electrical connector 10 comprises a male connector member 13 and a female connector member 15 to which the male connector member 13 is fitted. The reference numeral 17 denotes a seal member which will be inserted between the male and female connector members 13, 15 when they are fitted together, to seal therebetween.

As shown in FIG. 3, the male connector member 13 (which can be formed of a resin material) is formed into a substantially box-like shape. In the male connector member 13, there are defined a plurality of cavities each of which extends from the rear end of the connector member 13 to the front end thereof. Specifically, eight cavities 30*a* to 30*h* are arranged in upper and lower rows, in which each row includes four cavities. In the cavities 30*a* to 30*h*, eight female terminals 31, which are connected to wires 33*a* to 33*h*, are accommodated. Between the upper and the lower rows of the cavities 30*a* to 30*h*, there is defined a connecting member receiving space 29 in such a manner that a part of each cavity is communicated with the connecting member receiving space 29. Therefore, each of the female terminals 31 accommodated in each cavity is adapted to be exposed to the space. Further, there are a plurality of ribs 34 which partially protrude into the space from the under side of the upper row and the upper side of the lower row of the cavities. Each of the ribs 34 extends along the elongated direction of the male connector member 13.

Figure 4:
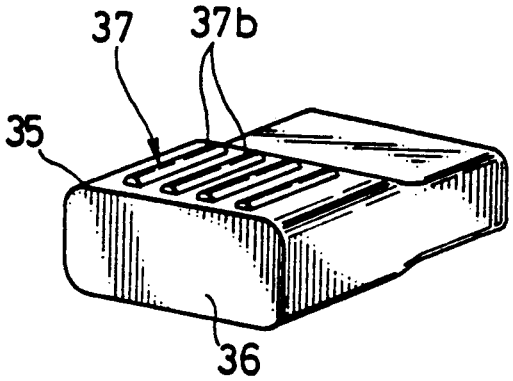
FIG. 4 is a perspective view showing a connecting member used in the connector of this embodiment.
Figure 5:
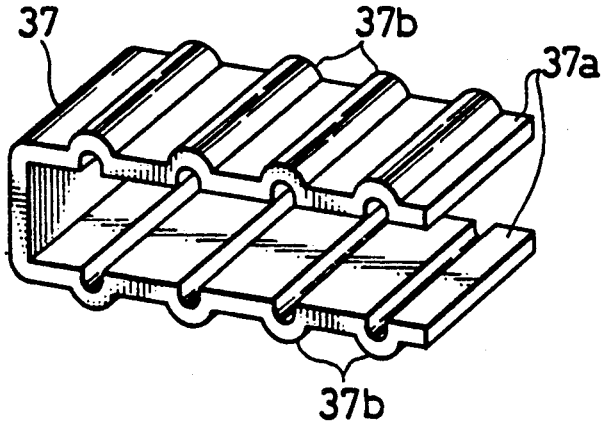
FIG. 5 is a conductive member used in the connecting member of this embodiment.

In FIG. 3, the reference numeral 35 denotes a connecting member for electrically connecting some desired terminals among the female terminals 31 accommodated in the cavities 30*a* to 30*h* to constitute a branch circuit. The connecting member 35 is constituted so as to be removably inserted into the connecting member receiving space 29. As clearly illustrated in FIG. 4, the connecting member 35 can be formed from a resin body 36 and a conductive member 37 which has been insert-molded into the resin body 36. The resin body 36 is formed into a substantially plate-like shape having a reduced thickness tip portion. As shown in FIG. 5, the conductive member 37 is formed into a substantially C-shaped configuration having two leg portions 37*a*. On each of the leg portions 37*a* of the connecting member 37, there are formed four semi-circularly protruding portions 37*b*. Thus formed conductive member 37 is embedded into the resin body 36 by insert-molding such that only a part of each protruding portion 37*b* extends from the outer surface of the resin body 36. In this embodiment, four protrusions 37*b* (which are electrically connected with each other) are exposed from each of the upper and lower surfaces of the plate-like resin body 36.

Figure 6:
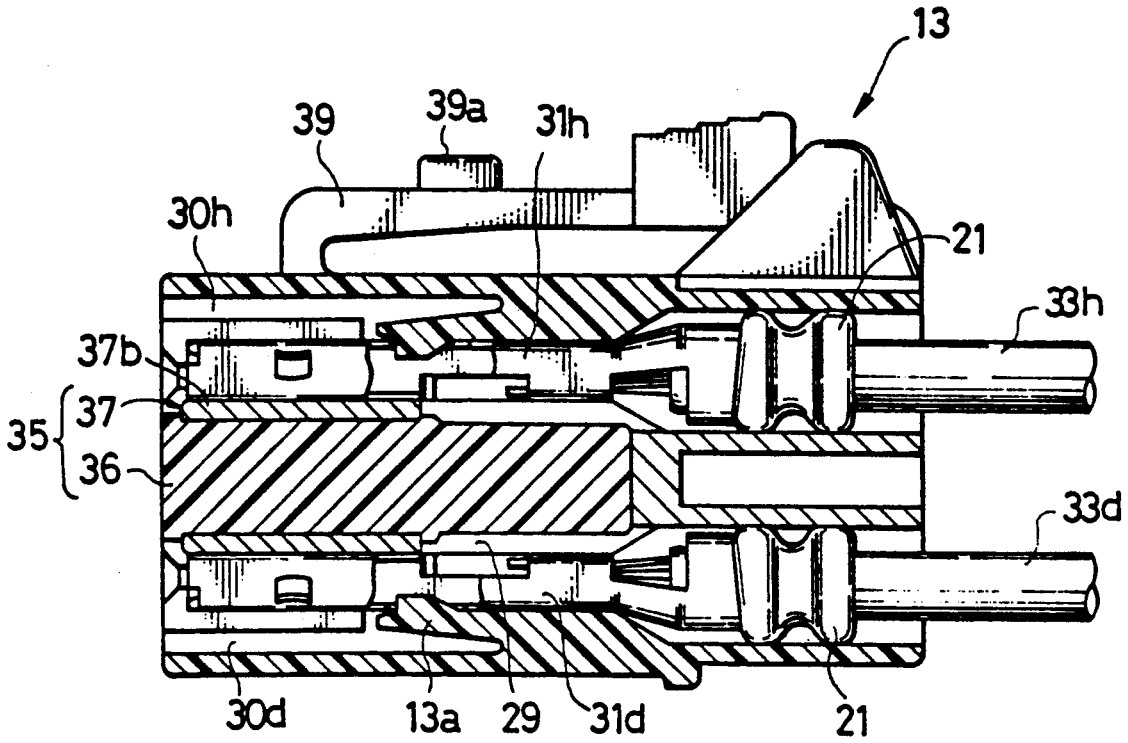
FIG. 6 is a cross sectional view of a male connector member of the first embodiment in which the connecting member is fitted.
Figure 7:
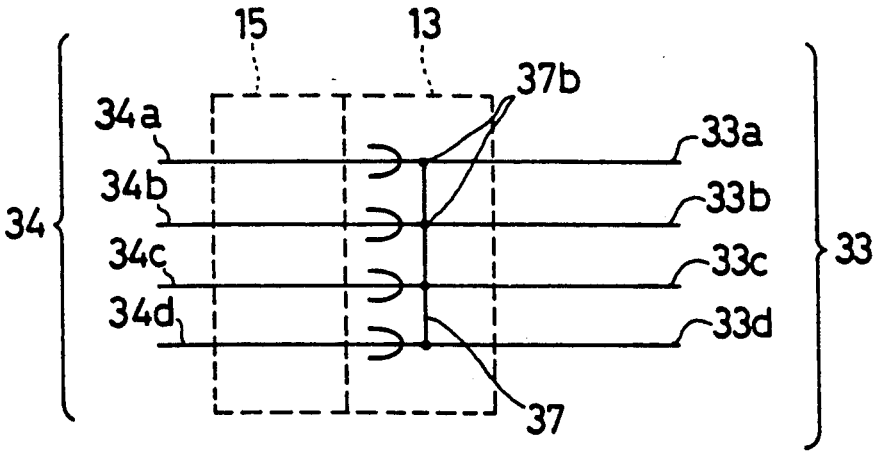
FIG. 7 is a diagram showing the electrical connector of this embodiment in use.

FIG. 6 shows the thus formed connecting member 35 inserted into the space 29 in the male connector member 13. As clearly shown in the drawing, each of the female terminals 31 (31*a* to 31*h*) is secured in the cavity 30 by means of a hook 13*a* which is provided in the connector member so as to protrude into each cavity. Further, a seal fastener 21 is also attached to an end of each wire, which serves to secure each female terminal 31 in the cavity 30. Under the condition shown in the drawing, each protruding portion 37*b* of the connecting member 35 is in contact with a part of the female terminal 31 accommodated in each cavity 30. In this case, since the protruding portions 37*b* are electrically connected with each other as stated in the foregoing, electrical connection will be established among the female terminals which are in contact with the protruding portions 37*b*. The connecting member 35 functions to establish electrical connection among the wires connected to the female terminals 31 which are electrically connected with each other through the conductive member 37 of the connecting member 35. Therefore, if one of the wires connected to the female terminal 31 is designated as a main wire to which electricity is supplied, it becomes possible to supply the electricity to the other wires which are connected to the female terminals 31 which are in contact with the protruding portions 37*b* of the conductive member 37. In this regard, it should be noted that the conductive member 37 of the connecting member 35 can be modified so as to change the number and arrangement of the protruding portions 37*b* exposed from the outer surface of the resin body 36, depending on the necessity of electrical connection of the wires for a branch circuit.

Referring now back to FIG. 3, the drawing shows that the male connector member 13 is fittable to the female connector member 15, in which the connector 10 functions as an intermediate connector. As clearly shown in the drawing, the female connector member 15 includes a cylindrical base portion 41 and a substantially cylindrical hood portion 42 extending from the base portion 41. In the base portion 41, there are provided a plurality of cavities (not shown) in which male terminals connected to wires 43*a* to 43*h* are accommodated in such a manner that the tip thereof extend into the hood portion 42. In this embodiment, these male terminals are also arranged in upper and lower rows each of which includes four cavities. This arrangement of the cavities corresponds to that of the cavities 30*a* to 30*h* for the female terminals 31 in the male connector member 13.

Thus constituted female connector member 15 is connected to the male connector member 13 by receiving the front end of the male connector member 13 into the hood portion 42 of the female connector member 15 from a front opening thereof in such a manner that each of the male terminals is inserted into the corresponding female terminal 31 in the male connector member 13. The female connector member 15 further includes a latching member 45 provided on an upper surface of the hood portion 42. The latching member 45 is engageable with a latched projection 39*a* of a latched member 39 provided on an upper surface of the male connector member 13 when the connector members 13 and 15 are properly fitted together.

Hereinafter, it will be described how to use the electrical connector according to the embodiment.

When the electrical connector 10 is used as a joint connector for connecting a main wire to other wires in order to constitute a branch circuit, the connecting member 35 having the above structure is inserted into the space 29 of the male connector member 13. In this case, the ribs 34 serve to guide the connecting member 35. As stated in the foregoing, the connecting member 35 of this embodiment has the eight protruding portions 37*b* formed on conductive member 37 as electrical contacts. These protruding portions 37*b* come to contact with the female terminals 31 accommodated in the cavities 30 of the male connector member 13 when the connecting member 35 is properly inserted into the connecting member receiving space 29. As a result, the wires 33*a* to 33*h* connected to the female terminals 31*a* to 31*h* are electrically connected with each other through the conductive member 37 of the connecting member 35, thus the combination of the male connector member 13 and the connecting member 35 serves as a joint terminal which can provide a branch circuit. In this regard, it should be noted that, as stated in the foregoing, the number of wires and the combination of wires to be connected with each other for providing a branch circuit, can be changed for this connector 10 by simply changing the number and arrangement of the protrusions 37*b* of the connecting member 35. This means that if some connecting members each having different number of the protrusions 37*b* and the different arrangment of the protrusions 37*b* are prepared in advance, various branch circuits can be obtained merely by changing the connecting member from one to another. Further, the manufacturing cost of these connecting members is relatively inexpensive because of their simple structure. Therefore, according to the improved electrical connector of this embodiment, it becomes possible to provide desired branch circuits easily and with low cost. According to the electrical connector of this embodiment, the degree of freedom for constituting branch circuits is remarkably increased.

When the electrical connector 10 of this embodiment is used as an intermediate connector for connecting wires connected to each connector member with each other, it is sufficient to fit the male connector member 13 to the female connector member 15 to connect thereby the male and female terminals together. The wires 33*a* to 33*h* connected thereby to the female terminals 31 in the male connector member 13 are electrically connected to the wires 43*a* to 43*h* connected to the male terminals in the female connector member 15. In this case, the connecting 35 may be removed, but it is preferable to use a connecting member formed from only a resin body 36 without a conductive member.

Further, it is also possible to connect both the connector members 13 and 15 with the connecting member 35 which includes a conductive member having a desired number and arrangement of protrusions 37*b* how the conductive member 37. If so, the electrical connector can be used not only as an intermediate connector but also as a joint connector. FIG. 6 is a diagram showing such a connector having both the functions of the joint connector and the intermediate connector.

In the above embodiment, the connecting member receiving space 29 is provided in the male connector member 13. However, it is also possible to provide such a space in the female connector member 15. Further, it is also possible to arrange the two rows of the cavities at the left and right sides of the connector member and to form a connecting member receiving space 29 between the two rows of the cavities.

In this disclosure, there is shown and described only the preferred embodiment of the present invention, but, as aforementioned, it is capable of making changes or modifications within the scope of the inventive concept as expressed herein.

What is claimed is:

1. An electrical connector, comprising:

a first connector housing having front and rear portions, including a plurality of cavities which are arranged in first and second rows so as to have a space therebetween, and a plurality of electrical terminals connected to wires extending from the rear portion thereof, wherein each of said cavities communicates with said space such that said electrical terminals are accommodated therein and are partially exposed to said space;

a second connector housing having front and rear portions, said second connector housing including a plurality of cavities which are arranged in first and second rows so as to have a space therebetween, and a plurality of electrical terminals connected to wires extending from the rear portion thereof, said front portion of said second connector housing being adapted to fit to said front portion of said first connector housing to establish electrical connection between the respective terminals in said first and second connector housings, and wherein each of the cavities communicates with said space such that the electrical terminals are accommodated therein and are partially exposed to said space; and a connecting member having a resin body, which is a separate part from said first and second connector housings, for establishing electrical connection among at least two of said terminals in one of said first and second connector housings, said connector member being adapted to be removably fitted into one of said first and second connector housings from said front portion thereof in said space and including a conductive member embedded in said resin body such that only a part of each contact is exposed beyond an outer surface of said resin body between said at least two electrical terminals to achieve electrical connection therebetween through said connecting member when fitted to one of said first and second connector housings; said connecting member being adapted to be removably fitted into said space;

wherein each of said at least two electrical contact means has an elongated semi-cylindrical shape which extends toward an insertion direction of said connecting member in said space.

* * * * *